US010661120B2

(12) United States Patent
Senk

(10) Patent No.: US 10,661,120 B2
(45) Date of Patent: May 26, 2020

(54) EXERCISE AND BALANCE TRAINING DEVICE

(71) Applicant: Ryno Power Equipment Inc., Owosso, MI (US)

(72) Inventor: Eric Walter Senk, Winchester, CA (US)

(73) Assignee: Ryno Power Equipment Inc., Owosso, MI (US)

( * ) Notice: Subject to any disclaimer, the term of this patent is extended or adjusted under 35 U.S.C. 154(b) by 99 days.

(21) Appl. No.: 16/001,994

(22) Filed: Jun. 7, 2018

(65) Prior Publication Data

US 2018/0369645 A1 Dec. 27, 2018

Related U.S. Application Data

(60) Provisional application No. 62/522,752, filed on Jun. 21, 2017.

(51) Int. Cl.

| | |
|---|---|
| ***A63B 26/00*** | (2006.01) |
| ***A63B 21/02*** | (2006.01) |
| ***A63B 22/16*** | (2006.01) |
| ***A63B 21/00*** | (2006.01) |
| ***A63B 69/16*** | (2006.01) |

(Continued)

(52) U.S. Cl.

CPC ..... *A63B 26/003* (2013.01); *A63B 21/023* (2013.01); *A63B 21/0442* (2013.01); *A63B 21/4019* (2015.10); *A63B 21/4034* (2015.10); *A63B 21/4035* (2015.10); *A63B 22/16* (2013.01); *A63B 22/18* (2013.01); *A63B 23/03525* (2013.01); *A63B 23/1236* (2013.01); *A63B 69/16* (2013.01)

(58) Field of Classification Search

CPC ..... A63B 26/003; A63B 21/4019; A63B 21/0442; A63B 23/03525; A63B 23/1236; A63B 22/18; A63B 21/4034; A63B 69/16; A63B 21/4035; A63B 22/16; A63B 21/023

See application file for complete search history.

(56) References Cited

U.S. PATENT DOCUMENTS 819,878 A * 5/1906 Grindy ..... A47C 1/11 297/181

2,746,754 A * 5/1956 Martel ..... A63G 13/08 472/105

(Continued)

*Primary Examiner* — Garrett K Atkinson

(74) *Attorney, Agent, or Firm* — Warner Norcross + Judd LLP

(57) ABSTRACT

An exercise training device includes a base, a balance board, and a coil spring. The balance board includes a pair of foot pegs located at the distal ends of the balance board. The coil spring has a longitudinal axis and is vertically mounted between the base and the balance board. The coil spring deflects in response to forces applied laterally relative to the longitudinal axis of the coil spring such that a user can perform strength and balance exercises by controlling the position of the balance board. The exercise training device can include a handlebar mount configured to secure handlebars of a motorcycle or bicycle thereto and can be used to represent movement of the handlebars of a motorcycle or bicycle a user experiences while riding. Multiple forms of exercise can be performed with the present exercise training device.

18 Claims, 11 Drawing Sheets

(51) Int. Cl.

| | |
|---|---|
| ***A63B 22/18*** | (2006.01) |
| ***A63B 23/12*** | (2006.01) |
| ***A63B 23/035*** | (2006.01) |
| ***A63B 21/04*** | (2006.01) |

(56) References Cited

U.S. PATENT DOCUMENTS 4,093,198 A * 6/1978 Petersen ..... A63G 13/08 267/179
4,509,743 A * 4/1985 Lie ..... A63B 69/18 482/71
4,601,469 A * 7/1986 Sasser, Jr. ..... A63B 22/16 482/146
4,728,087 A * 3/1988 Wils ..... F16F 1/122 248/624
4,739,986 A * 4/1988 Kucharik ..... A63B 23/08 482/146
4,966,364 A * 10/1990 Eggenberger ..... A63B 69/0093 482/146
5,002,272 A * 3/1991 Hofmeister ..... A63B 21/028 482/127
5,062,629 A * 11/1991 Vaughan ..... A63B 22/18 482/147
5,352,176 A * 10/1994 Huang ..... A63B 21/0004 482/123
5,522,772 A * 6/1996 Chenard ..... A63G 13/08 472/103
5,533,899 A * 7/1996 Young ..... G09B 9/058 434/61
5,582,565 A * 12/1996 Soria ..... A63B 21/00047 482/141
5,590,930 A * 1/1997 Glockl ..... A47C 3/0257 297/258.1
5,713,823 A * 2/1998 Walendzak ..... A63B 22/18 482/139
5,795,277 A * 8/1998 Bruntmyer ..... A63B 21/0004 280/87.041
6,413,197 B2 * 7/2002 McKechnie ..... A63B 22/18 482/127
6,705,977 B1 * 3/2004 Ziak ..... A63B 21/0004 472/135
7,357,766 B2 * 4/2008 Langer ..... A63B 21/0004 482/146
7,476,188 B2 * 1/2009 Perez, Jr. ..... A63B 23/0211 472/103
7,645,221 B1 * 1/2010 Curry ..... A63B 21/023 482/142
7,682,296 B2 * 3/2010 Brown ..... A63B 21/0085 482/113
7,806,807 B2 * 10/2010 Genua ..... A63B 21/0004 482/146
8,864,638 B2 * 10/2014 Ross ..... A63B 21/1636 482/141
9,468,804 B2 * 10/2016 Knox ..... A63B 23/1236
9,533,191 B2 * 1/2017 Carbone ..... A63B 26/003
9,731,163 B2 * 8/2017 Henson ..... A63B 22/18
9,987,518 B1 * 6/2018 Stack ..... A63B 22/16
2009/0230743 A1 * 9/2009 Derakhshan ..... A47C 9/002 297/329
2009/0318274 A1 * 12/2009 Welsh ..... A63B 21/023 482/142
2014/0256526 A1 * 9/2014 Henson ..... A63B 22/18 482/146

* cited by examiner

EXERCISE AND BALANCE TRAINING DEVICE

CROSS-REFERENCE TO RELATED APPLICATION

This application claims the benefit of U.S. Provisional Application 62/522,752, filed Jun. 21, 2017, the disclosure of which is hereby incorporated by reference in its entirety.

BACKGROUND OF THE INVENTION

The present invention relates to an exercise device, and in particular, an exercise and training device for improving a user's balance and strength.

A good sense of balance is generally advantageous, and is especially pertinent to particular activities or sports. Many popular sports activities require a well-developed sense of balance in order to become proficient. For example, sports such as motocross, cycling, skiing, snowboarding, skateboarding and the like all involve the use of equipment that requires the user to be able to accurately control their position on the equipment. Continuous shifting and adjusting of the user's weight and center of gravity with respect to the equipment at appropriate times is vital to proper use of the equipment and mastery of the sport.

Motocross, on either motorcycles or bicycles (known as cyclocross), is a popular form of off-road racing held on various racecourses. Motocross is a physically demanding sport that requires proper physical conditioning. At competitive levels, the sport requires excellent physical fitness and is a rigorous cardiovascular workout. There are different types of motocross events, some of which require the rider to corner the motorcycle at an inclined position. One area of conditioning that is therefore needed is the rider's abdomen or core. Another area of importance is upper body strength. The landing after going over a jump will challenge the strongest upper body. Strong muscles in the chest, shoulders, and arms improve shock-absorbing abilities of the arms and upper torso.

A variety of exercises have been known to strengthen the core and upper torso. However, there remains a continued need for an improved exercise device for a variety of strengthening and balance exercises for training motocross riders and other users.

SUMMARY OF THE INVENTION

The present invention provides an exercise training device that includes a base, a balance board, and a coil spring. The balance board has an upper surface, a lower surface, and a pair of foot pegs located at distal ends of the balance board. The coil spring has a longitudinal axis and is vertically mounted between the base and the balance board. The coil spring deflects in response to forces applied laterally to the longitudinal axis of the coil spring such that a user can perform strength and balance exercises by controllably maneuvering the balance board between an initial horizontal position and an inclined position when subject to sufficient force.

In another embodiment, an exercise training device for developing strength and balance skills useful for motocross racing includes a base, a balance board, a handlebar mount, and a biasing element. The balance board has an upper surface, a lower surface, and a pair of foot pegs located at the distal ends of the balance board. The handlebar mount is configured to secure handlebars of a motorcycle or bicycle thereto. The biasing element extends upwardly from the base to the balance board, with the balance board being spaced from the base by the biasing element. The handlebar mount is adapted to removably secure the handlebars to the balance board. The biasing element is axially compressible and can deflect relative to the vertical direction and is representative of movement of the handlebars of a motorcycle or bicycle.

In another embodiment, an exercise training device includes a base, a balance board, and a coil spring. The balance board has an upper surface, a lower surface, and a pair of foot pedals located at opposed ends of the balance board. The foot pedals are offset from one another in both a fore-aft direction and a lateral direction. The coil spring has a longitudinal axis and is vertically mounted between the base and the balance board. The coil spring deflects in response to forces applied laterally to the longitudinal axis of the coil spring such that a user standing on the balance board can controllably maneuver the balance board to maintain the balance board in a substantially horizontal position to simulate riding in the standing position.

These and other features and advantages of the present invention will become apparent from the following description of the invention, when viewed in accordance with the accompanying drawings and appended claims.

DESCRIPTION OF CURRENT EMBODIMENTS

Figure 1:
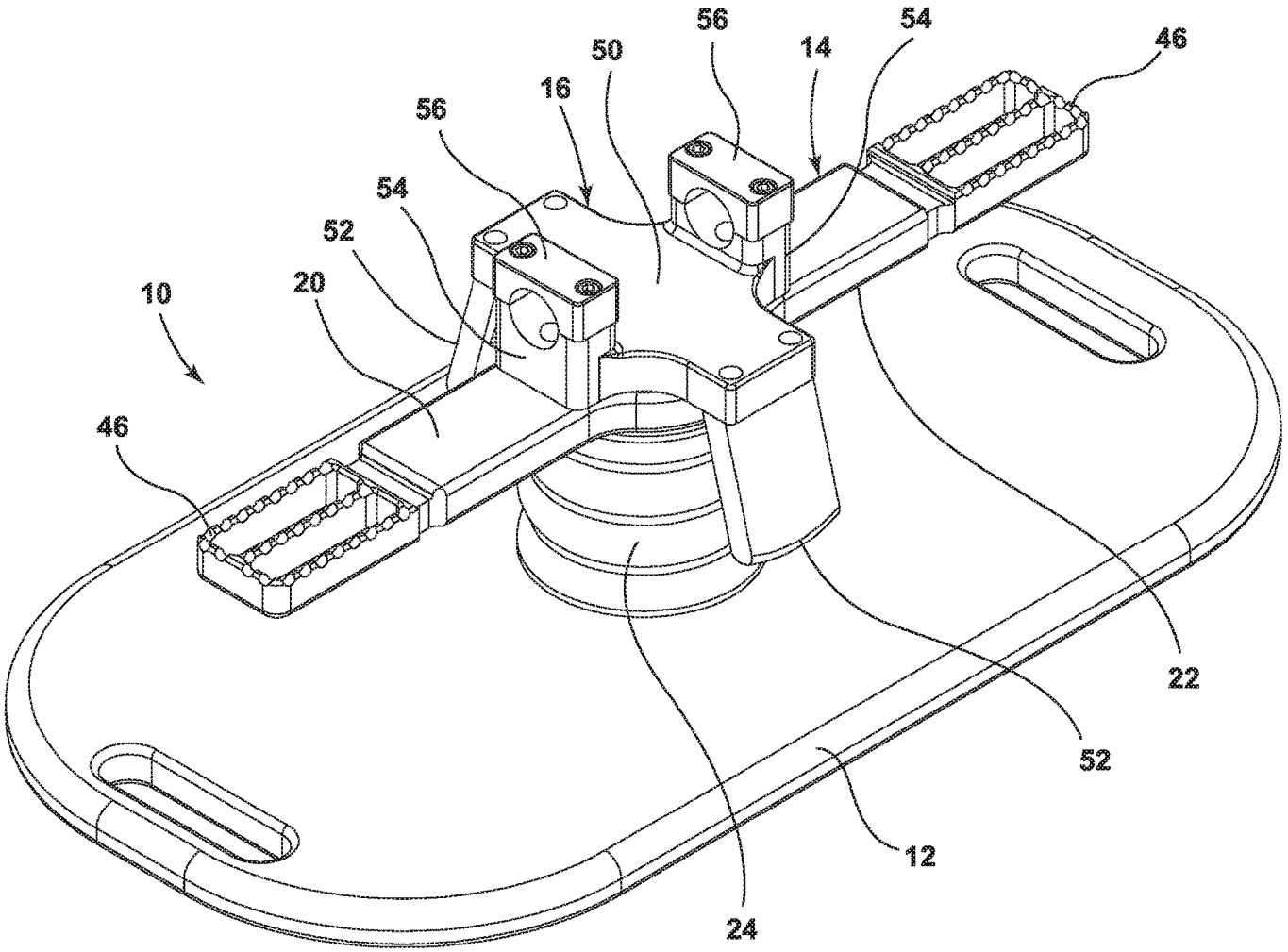
FIG. 1 is a perspective view of an exercise training device according to one embodiment of the present invention.

Referring to FIGS. 1-5, an exercise training device according to one embodiment of the present invention is generally shown at 10. The training device 10 includes a base 12, a foot peg balance board 14, and a handlebar mount 16 to which motorcycle handlebars 18, bicycle handlebars, or other type of bar, may be mounted. The handlebars may be actual motorcycle handlebars, a model of or a structure representative of handlebars, and may be only a portion of the handlebars rather than the entire handlebar. The balance board 14 includes an upper surface 20 and a lower surface 22. A biasing element 24 is vertically mounted between the base 12 and the balance board 14. As illustrated in the figures, the biasing element may be in the form of a compression or coil spring. The balance board 14 is spaced from the base 12 by the coil spring 24. More specifically, an upper end 26 of the coil spring 24 is affixed to the lower surface 22 of the balance board 14, and a lower end 28 of the coil spring 24 is affixed to the base 12.

The base 12 is a rigid structural member. Referring to the example illustrated in FIG. 3, the center of the base 12 includes two base mounting holes 30 to which the coil spring 24 can be mounted using conventional bolts or other fasteners. The base 12 may include one or more handles.

Figure 2:
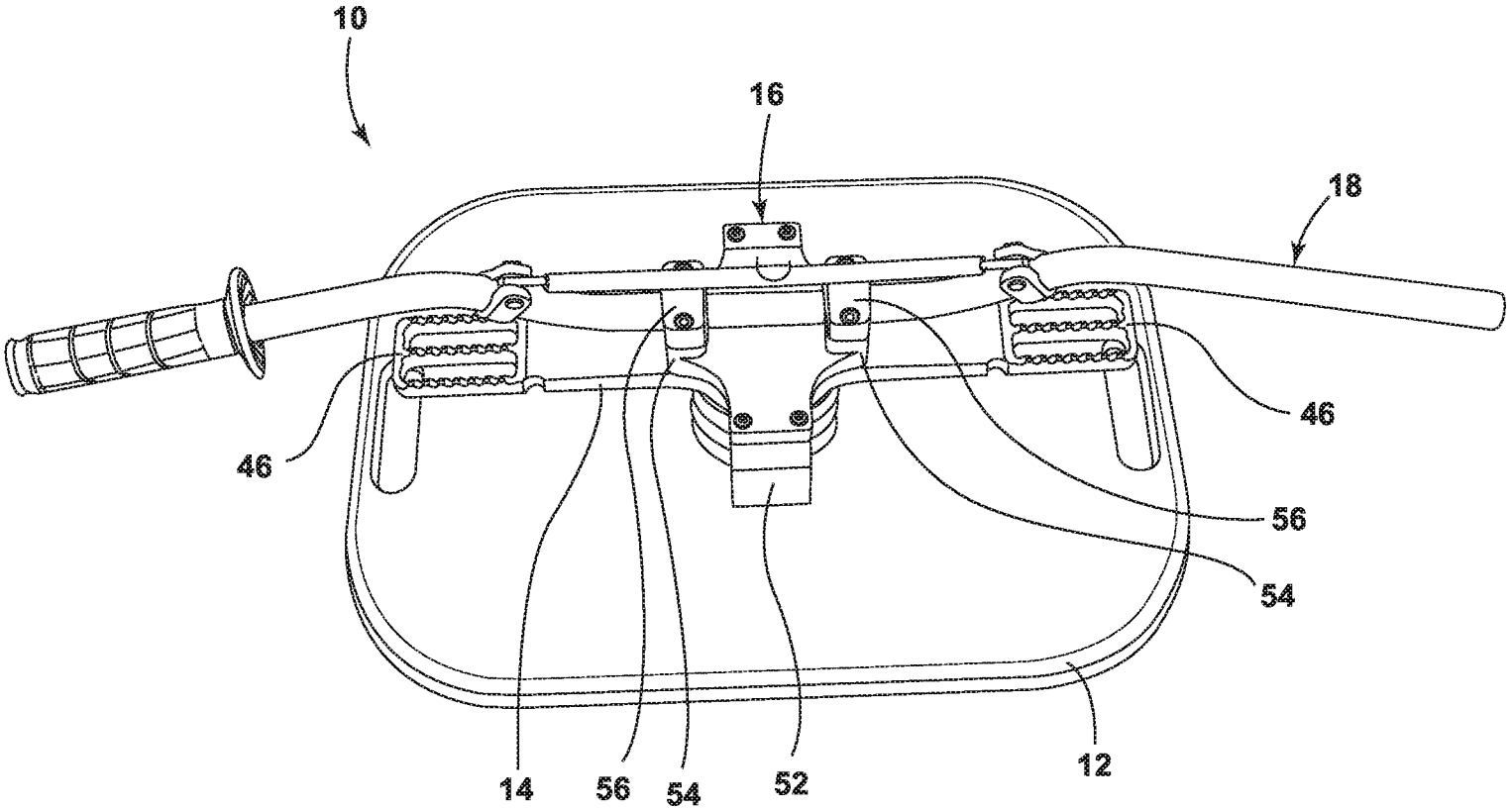
FIG. 2 is a perspective view of the exercise training device with handlebars mounted thereto.
Figure 3:
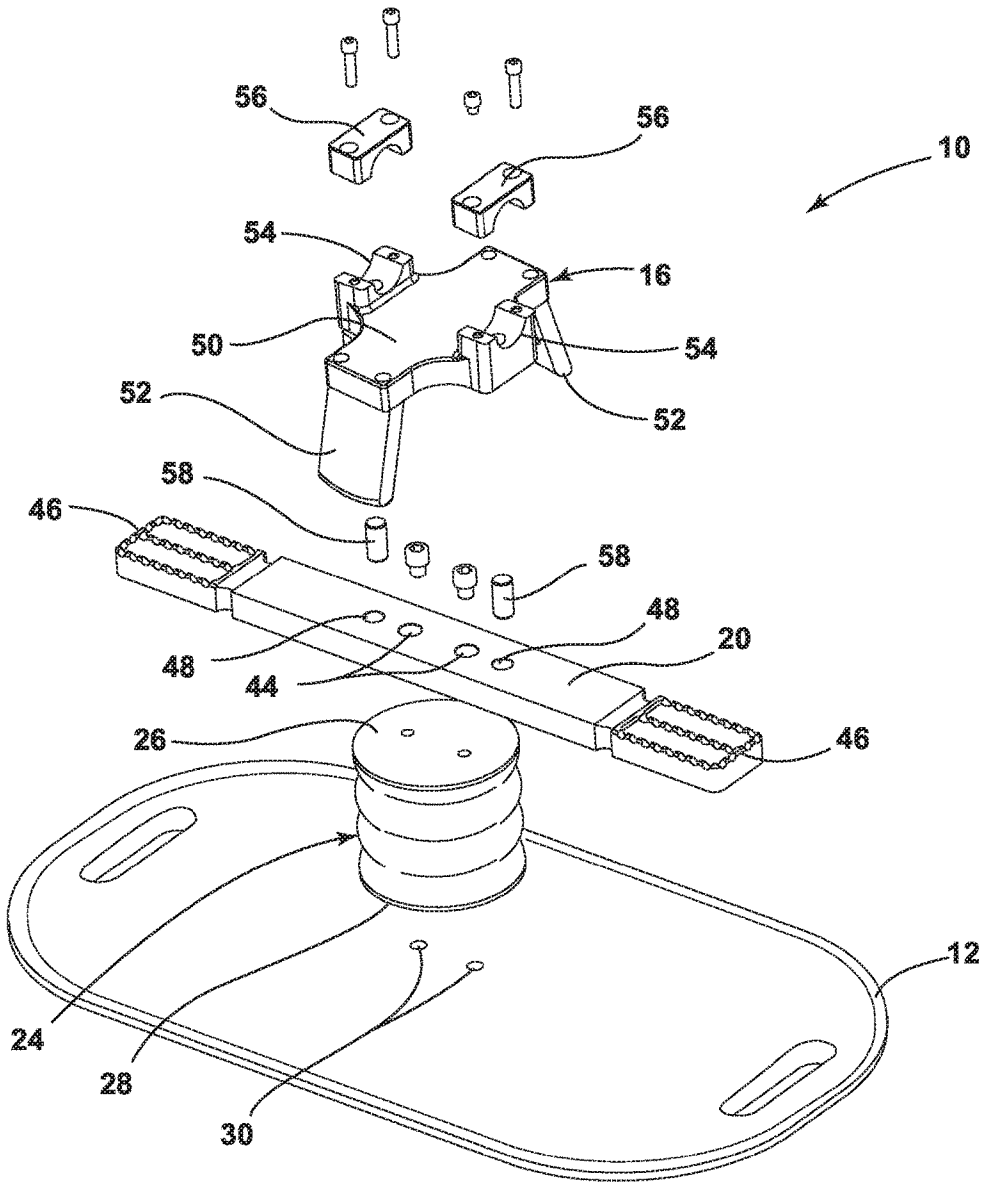
FIG. 3 is an exploded view of the exercise training device of FIG. 1.

Referring to FIGS. 2-3, the foot peg balance board 14 is an elongated, planar, and rigid member. Two balance board mounting holes 44 are disposed near a center of the balance board 14 through which conventional bolts or other fasteners pass for affixing the balance board 14 to the coil spring 24. The balance board 14 includes a pair of replica motorcycle or bicycle foot pegs 46 at the distal ends thereof. The balance board 14 also includes one or more handlebar mounting holes 48, the purpose of which will be described in greater detail hereinafter.

As seen in FIGS. 1-3, the handlebar mount 16 is an irregularly shaped member that includes a center plate 50, downward extending fore-aft stops 52, and spaced handlebar clamps 54. The stops 52 extend down, below the balance board 14 and limit how far the balance board 14 can tilt in the fore-aft direction. The stops 52 have a length such that the front stop 52 restricts the degree of forward tilt to which the balance board 14 and handlebars 18 can be tilted forward, and the rear stop 52 restricts the degree of rearward tilt to which the balance board 14 and handlebars 18 can be tilted backward. This configuration can help prevent a user from losing control of the balance board 14 and handlebars 18. Further, while the stops are shown as downward extending bars, it should be understood that stops may be in the form of straps, ropes, springs, cables, or any other suitable stop.

The handlebar clamps 54 include a curved clamping surface. The handlebar mount 16 also includes upper clamps 56 that are removably secured to the handlebar clamps 54. Handlebars 18 can be affixed to the handlebar mount 16 by clamping the handlebars 18 between the handlebar clamps 54 and the upper clamps 56. Further, the handlebar mount 16 includes one or more dowels 58 (shown in FIG. 3) that extend down from the center plate 50. The dowels 58 can be inserted into the handlebar mounting holes 48 on the balance board 14 to install the handlebars 18 to the training device 10.

As described above, the coil spring 24 of the training device 10 is mounted between the base 12 and the foot peg balance board 16. The coil spring 24 is compressible in the vertical direction and provides 360° of movement in a direction offset from the vertical direction and coincident with the longitudinal axis of the coil spring 24. The coil spring 24 biases the foot peg balance board 16 into its horizontal position and allows deflection in response to lateral forces such that the foot peg balance board 16 can pitch and roll when subject to sufficient force to overcome the bias of the coil spring 24. It should be understood that lateral forces and movement as used herein refer to forces applied perpendicular to a longitudinal axis of the coil spring 24, resulting in movement of the coil spring 24 in a generally inverted conical-shaped space. Further, the spring force or spring constant of the coil spring 24 is selected to provide an appropriate amount of force to support the weight of a user, as well as to provide an appropriate amount of force such that the user may overcome the coil spring 24 to move the foot peg balance board 16 in a direction offset from its horizontal orientation. In addition, the biasing element is rotatable about its longitudinal axis in response to an applied torque and is tiltable about its longitudinal axis in response to an applied moment.

The training device 10 enables a user to perform strength and balance exercises. The user can controllably maneuver the foot peg balance board 14 between an initial horizontal position, a laterally inclined position, and/or a fore-aft inclined position. The user, using primarily his or her abdominal muscles, maneuvers the position of the foot peg balance board 14 by leaning to side-to-side and/or fore-aft. If the user would like to add resistance to make the exercise more difficult, the user can hold a weight in one or both hands.

Figure 4:
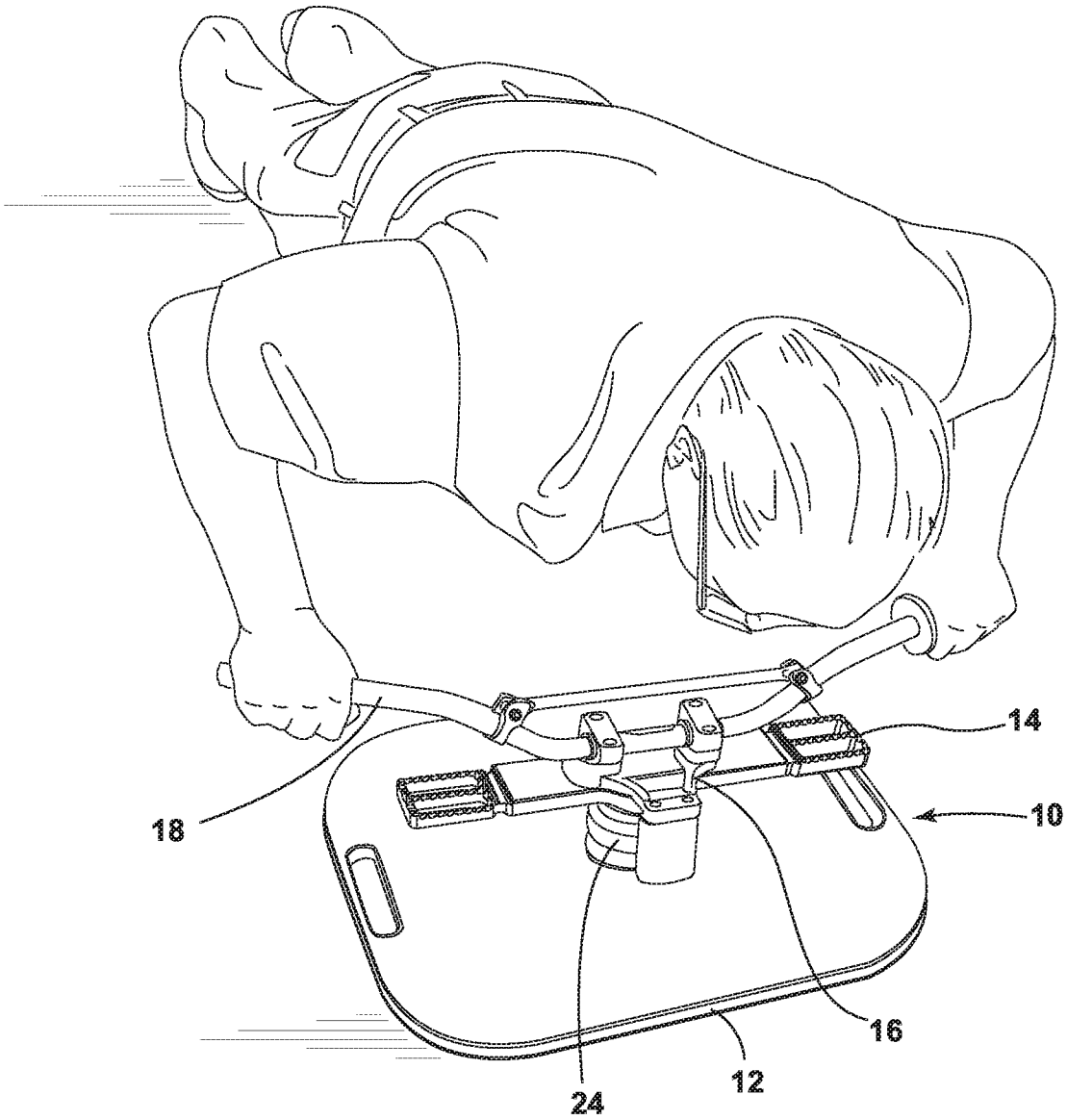
FIG. 4 illustrates a user using the exercise training device in a first form of exercise.
Figure 5:
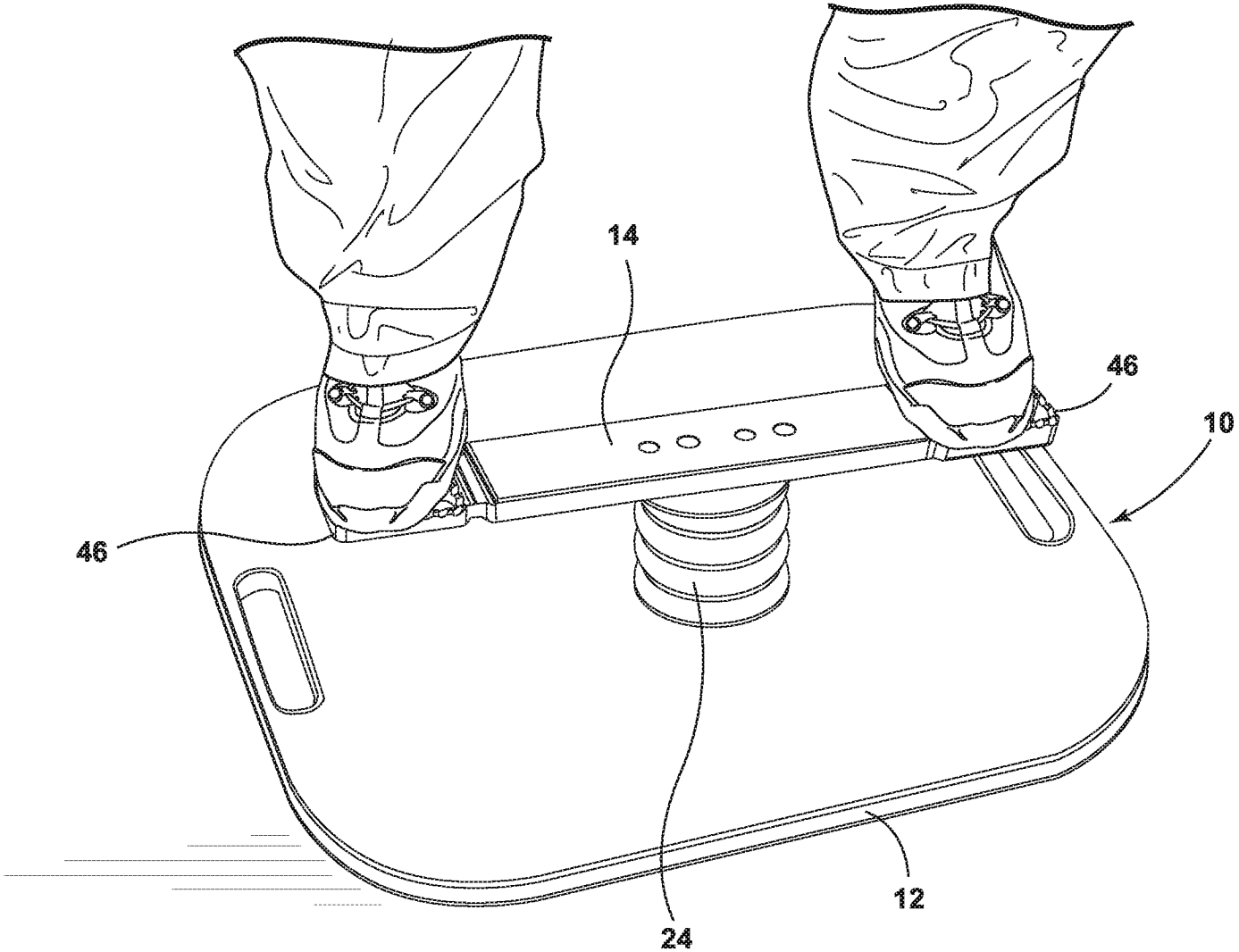
FIG. 5 illustrates a user using the exercise training device in a second form of exercise.

Further, the training device 10 can be used for at least two forms of exercise. As shown in FIG. 4, the training device may be used with the handlebars 18 mounted thereto for performing primarily chest and torso exercises. The user may use the training device, as one example, in push-up or plank position and gripping the handlebars 18, as illustrated in FIG. 4. The spring 24 allows the balance board 14 and affixed handlebars 18 to pitch and roll such that the user must exert an effort to keep the balance board 14 and handlebars 18 steady and/or level. A variety of exercises could be performed with the handlebars 18 mounted to the training device 10. The training device 10 may also be used as a standing balance trainer, as illustrated in FIG. 5. In this example, the handlebars 18 and handlebar mount 16 are removed, and a user stands with their feet on the foot pegs 46. Again, a variety of exercises could be performed in this configuration, including squats, for example.

Figure 6:
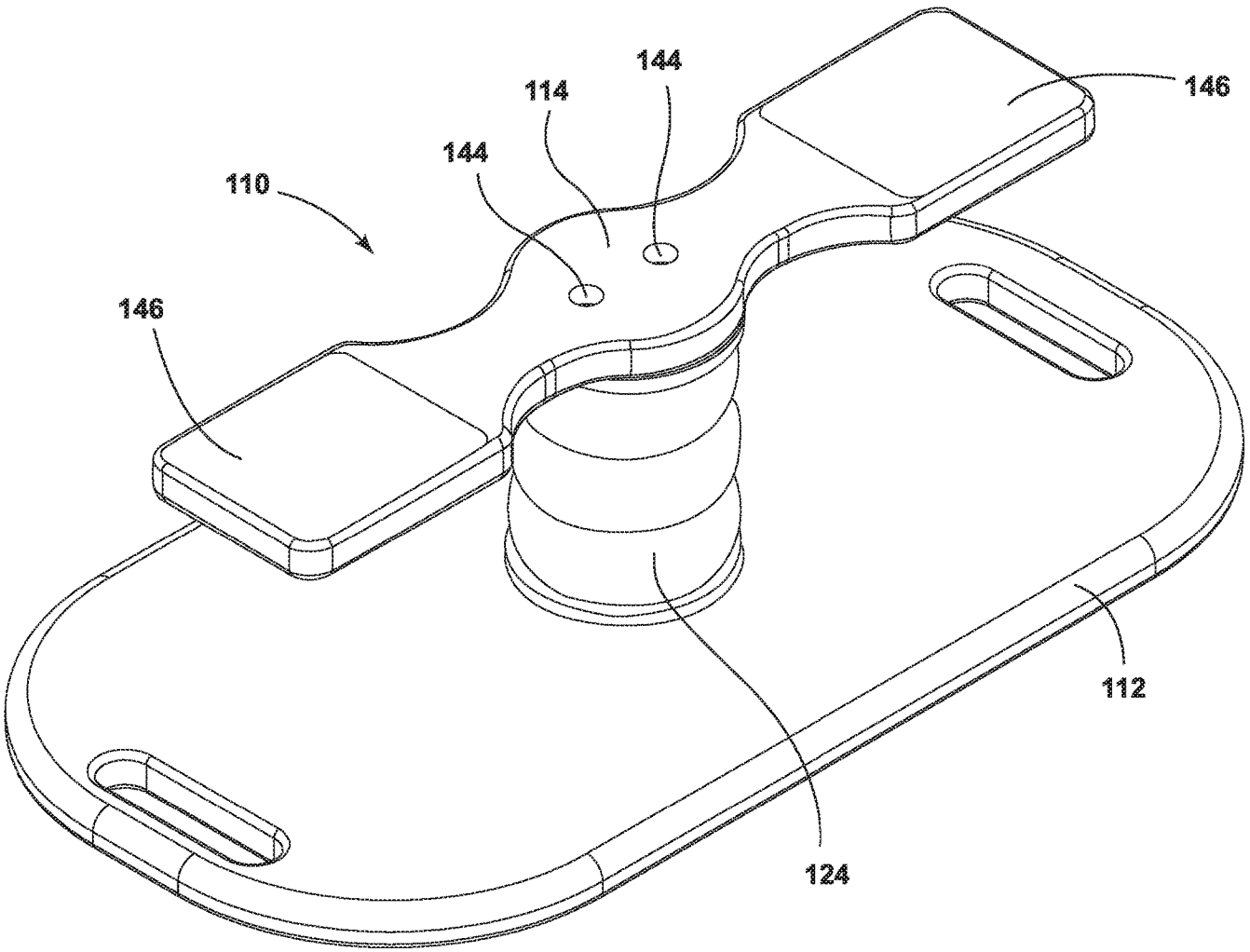
FIG. 6 is a perspective view of an exercise training device according to a second embodiment of the present invention.
Figure 7:
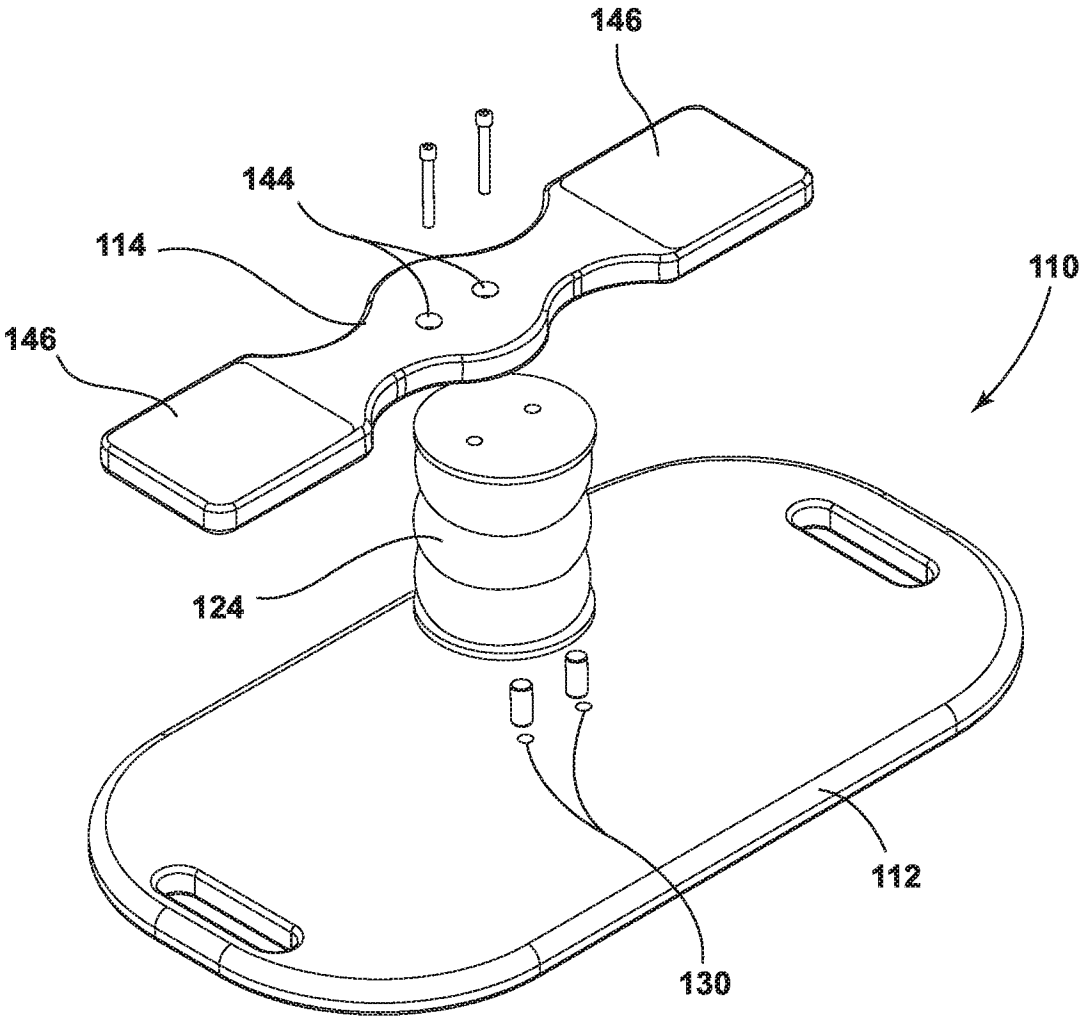
FIG. 7 is an exploded view of the exercise training device of FIG. 6.
Figure 8:
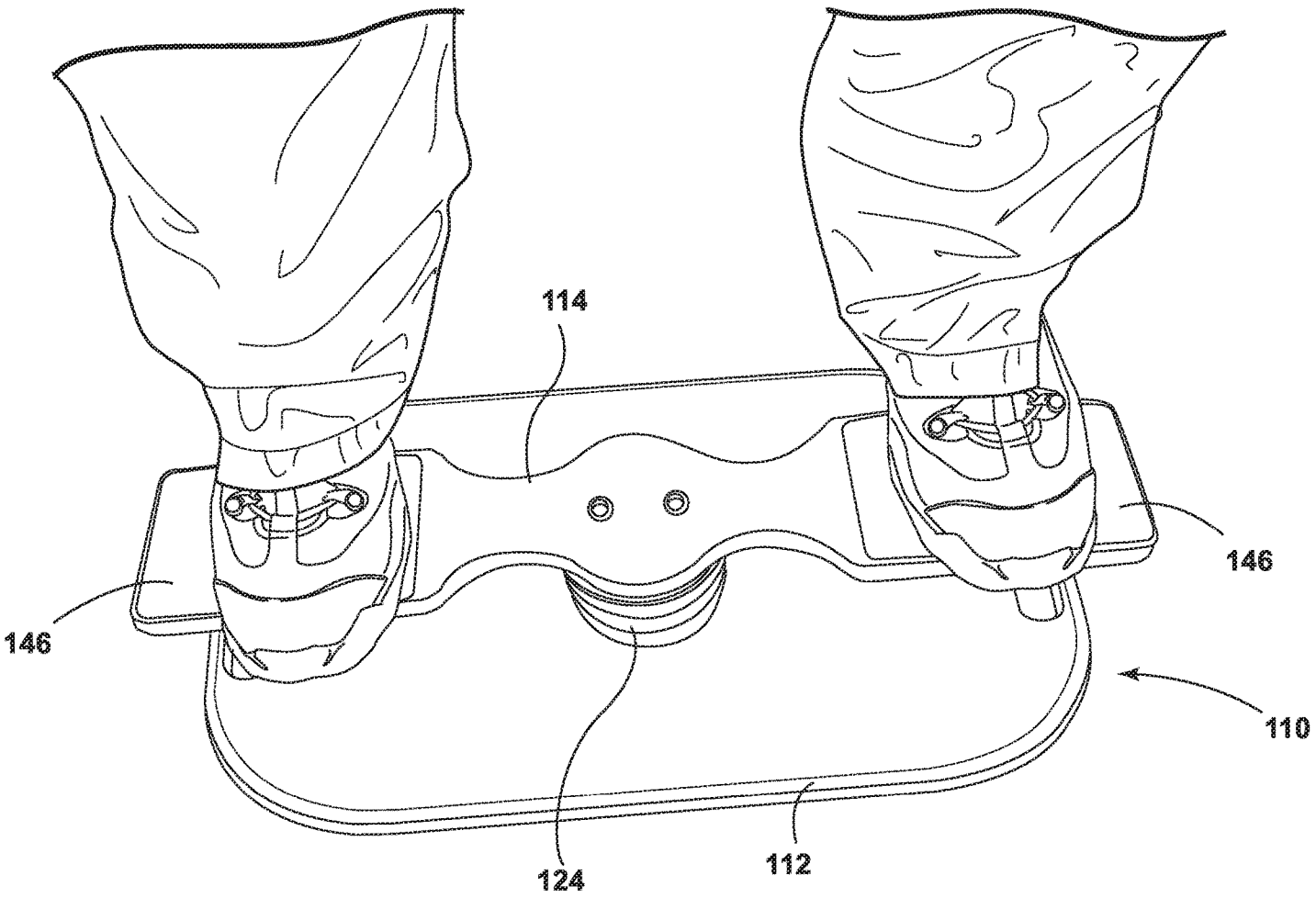
FIG. 8 illustrates a user using the exercise training device of FIG. 6.

Referring to FIGS. 6-8, a second embodiment of an exercise training device is shown. The second embodiment 110 is similar to the first embodiment 10, and like parts are identified with like numerals increased by 100, with it being understood that the description of the like parts of the first embodiment applies to the second embodiment, unless otherwise noted. The training device 110 includes a base 112 and a foot balance board 114. The foot balance board 114 is an elongated, planar, and rigid member that is affixed to the coil spring 124 by conventional bolts or other fasteners that extend through balance board mounting holes 144. Further, the foot balance board 114 includes a pair of spaced foot supports 146 at the distal ends thereof. The training device 110 may be used as a standing balance trainer, as illustrated in FIG. 8, similar as described above with respect to the first embodiment. In this example, the user stands with his or her feet on the foot supports 146. Again, a variety of exercises could be performed in this configuration.

Figure 9:
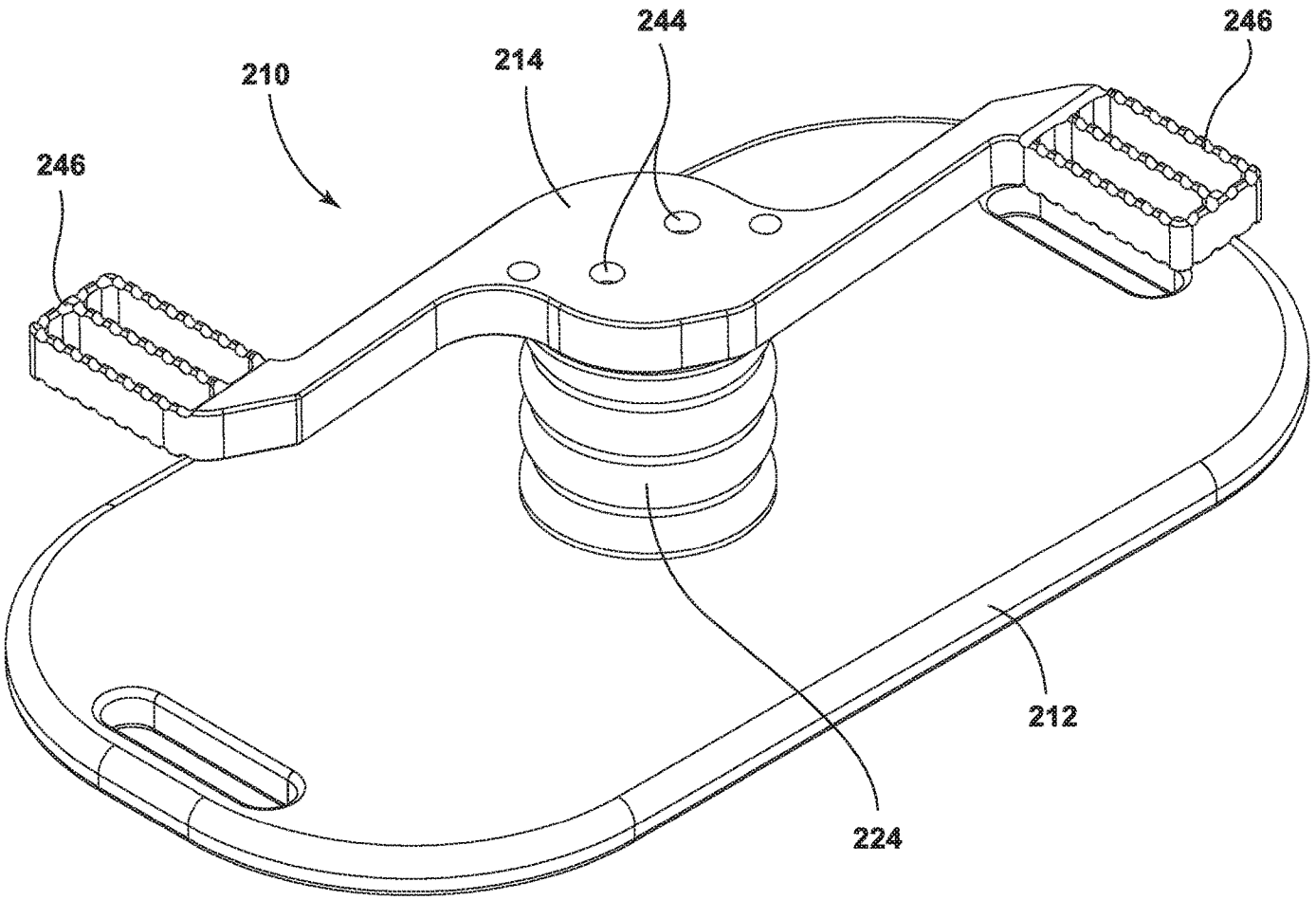
FIG. 9 is a perspective view of an exercise training device according to a third embodiment of the present invention.
Figure 10:
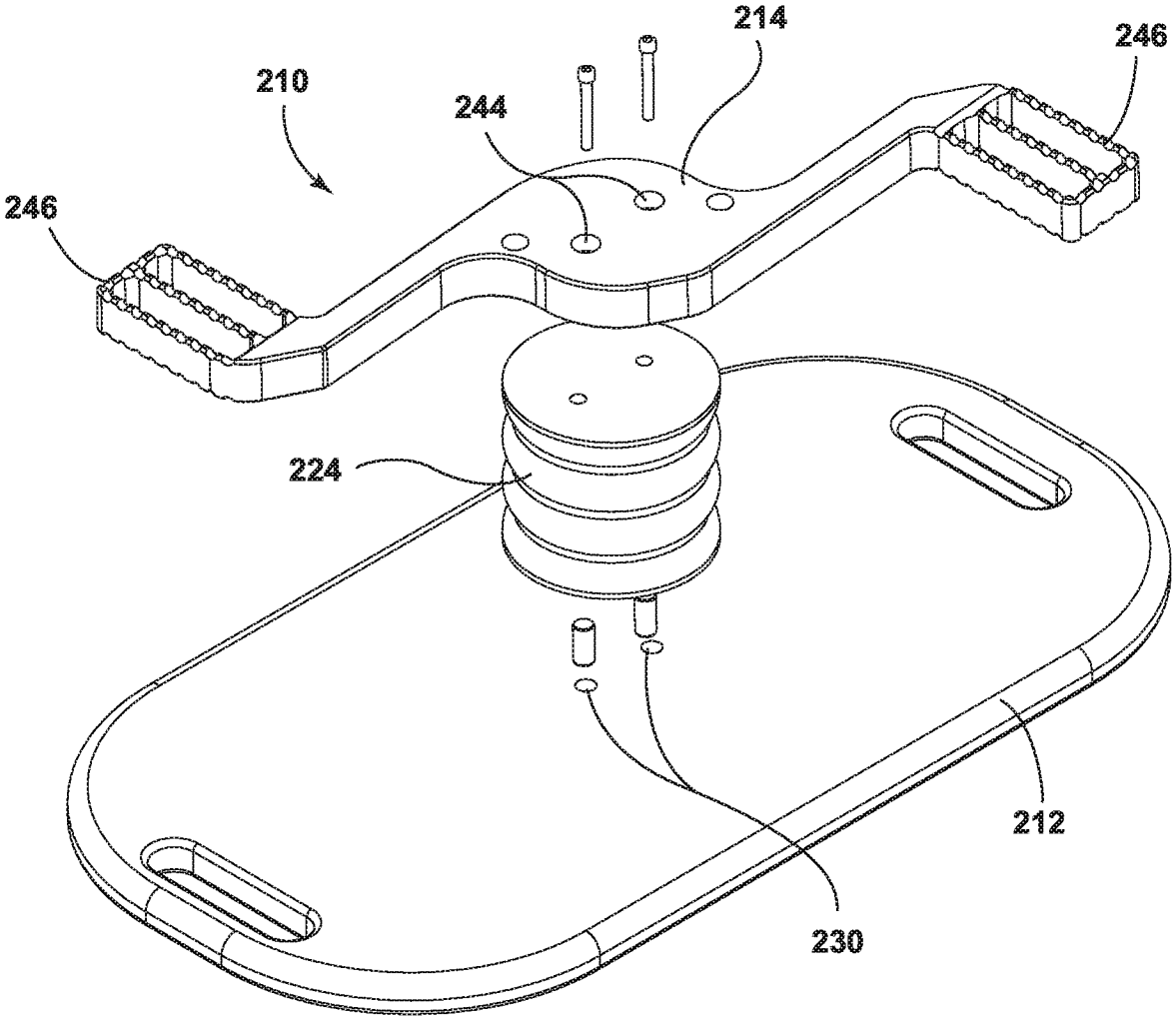
FIG. 10 is an exploded view of the exercise training device of FIG. 9.
Figure 11:
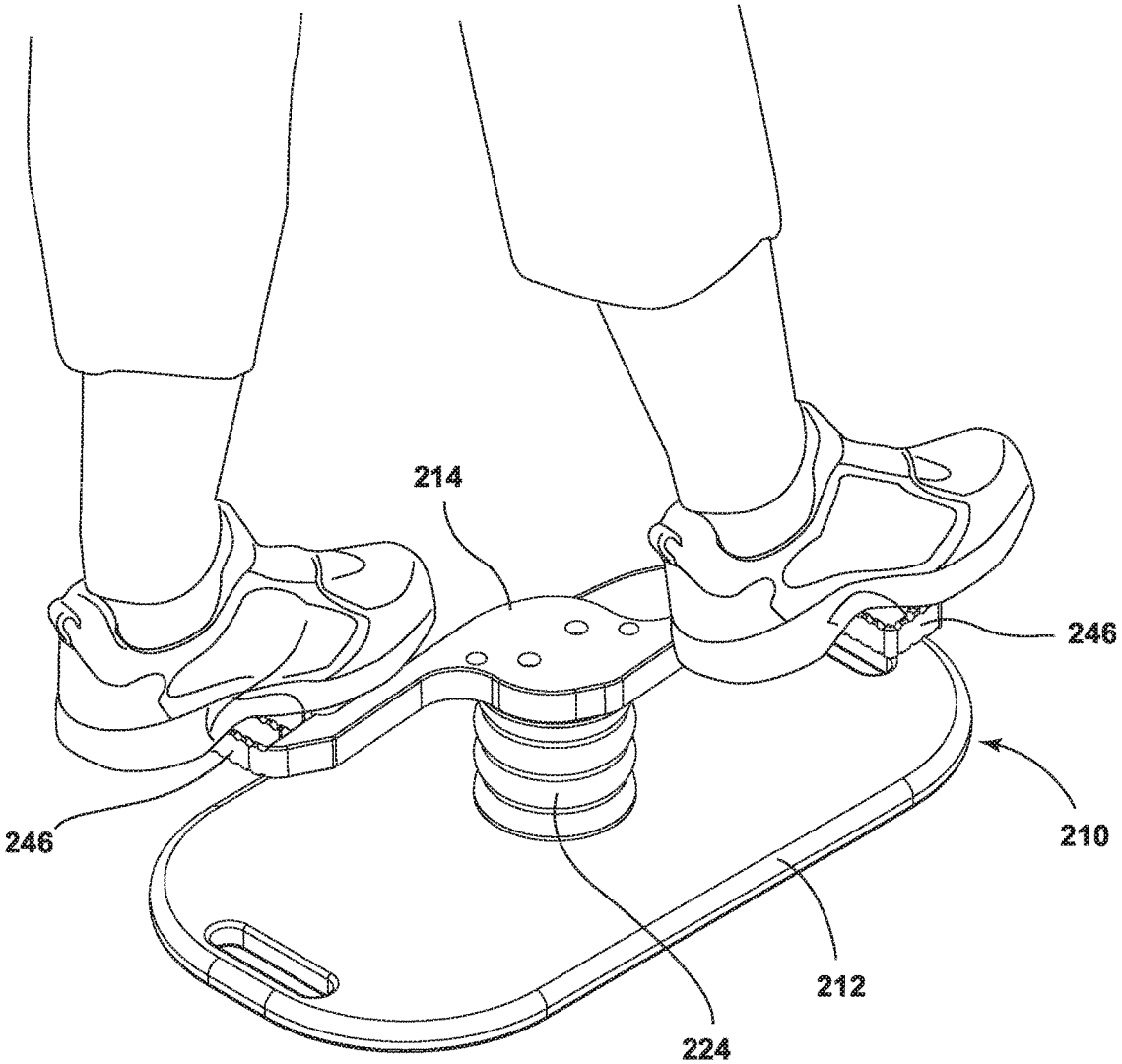
FIG. 11 illustrates a user using the exercise training device of FIG. 9.

Referring to FIGS. 9-11, a third embodiment of an exercise training device is shown. The third embodiment 210 is similar to the first embodiment 10, and like parts are identified with like numerals increased by 200, with it being understood that the description of the like parts of the first embodiment applies to the second embodiment, unless otherwise noted. The training device 210 includes a base 212 and a bicycle balance board 214. The bicycle balance board 214 is an elongated, planar, and rigid member that is affixed to the coil spring 224 by conventional bolts or other fasteners that extend through balance board mounting holes 244. Further, the bicycle balance board 214 includes a pair of spaced foot pedals 246 at the distal ends thereof. The foot pedals 246 of the third embodiment are offset from one another in the fore-aft direction and can be used to simulate standing on the pedals of a bicycle. The training device 210 may be used as a standing balance trainer, as illustrated in FIG. 11, to simulate riding a bicycle in the standing position, as is often seen in BMX, cyclocross, and other extreme bicycle sports. In this example, the user stands with his or her feet on the offset foot pedals 246 to balance the bicycle balance board 214. Again, a variety of exercises could be performed in this configuration.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s). Any reference to claim elements in the singular, for example, using the articles "a," "an," "the" or "said," is not to be construed as limiting the element to the singular.

The invention claimed is:

1. An exercise training device comprising:

a substantially planar base;

a balance board including an upper surface and a pair of foot pegs disposed at distal ends thereof;

a handlebar mount secured to the upper surface of the balance board and adapted to receive a removable handlebar, the handlebar mount including fore and aft stops extending downwardly therefrom for engaging the substantially planar base when the balance board is deflected forward and rearward, respectively; and a coil spring having a longitudinal axis and vertically mounted between the base and the balance board, wherein the handlebar mount is disposed above the coil spring and is aligned with the longitudinal axis of the coil spring, and wherein the coil spring is adapted to deflect in response to forces applied laterally to the longitudinal axis of the coil spring such that a user can perform strength and balance exercises by controllably maneuvering the balance board between an initial horizontal position and an inclined position when subject to sufficient force by the user.

2. The exercise training device of claim 1, wherein the fore and aft stops limit deflection of the balance board relative to the base.

3. The exercise training device of claim 1, wherein the pair of foot pegs are laterally aligned with each other.

4. The exercise training device of claim 1, wherein the pair of foot pegs are offset from each other in a fore-aft direction.

5. The exercise training device of claim 1, wherein the coil spring biases the balance board in a substantially horizontal position and allows pitch and roll of the balance board when subject to force sufficient to overcome a biasing force of the coil spring.

6. The exercise training device of claim 1, wherein the coil spring defines upper and lower ends, and wherein the upper end can deflect relative to the lower end.

7. A multi-purpose exercise training device for developing strength and balance skills useful for motocross racing, comprising:

a substantially planar base;

a balance board having an upper surface and a pair of foot pegs located at distal ends thereof;

a handlebar mount secured to the upper surface of the balance board and configured to removably secure handlebars of a motorcycle or bicycle to the balance board, the handlebar mount including fore and aft stops extending downwardly therefrom for engaging the substantially planar base when the balance board is deflected forward and rearward, respectively; and a biasing element extending upwardly between the base and the balance board, the balance board being spaced from the base by the biasing element and the handlebar mount being disposed above the biasing element and aligned with a longitudinal axis of the biasing element, the biasing element being axially compressible and being deflectable about its longitudinal axis, such that movement of the balance board is representative of movement of handlebars of a motorcycle or a bicycle, wherein the training device is configured for exercising in a first mode with handlebars to perform upper body exercises and a second mode without handlebars to perform standing exercises.

8. The training device of claim 7, wherein the biasing element comprises a coil spring.

9. The training device of claim 7, wherein the handlebar mount includes first and second handlebar clamps.

10. The training device of claim 7, wherein the biasing element is rotatable about its longitudinal axis in response to an applied torque.

11. The training device of claim 7, wherein the fore and aft stops are configured to restrict movement in a fore-aft direction relative to the affixed handlebars.

12. The training device of claim 11, wherein the first and second stops comprise downward extending members that slope outwardly relative to the handlebar mount.

13. The training device of claim 7, wherein the biasing element maintains the balance board in a substantially horizontal position and allows pitch and roll of the balance board when subject to force sufficient to overcome the bias of the biasing element.

14. An exercise training device comprising:

a substantially planar base;

a balance board having an upper surface and a pair of foot pedals disposed at opposed ends of the balance board, the foot pedals being offset from one another in a fore-aft direction and a lateral direction;

a handlebar mount removably secured to the upper surface of the balance board and adapted to receive a removable handlebar, the handlebar mount including fore and aft stops extending downwardly therefrom for engaging the substantially planar base when the balance board is deflected forward and rearward; and a coil spring defining a longitudinal axis and being vertically mounted between the base and the balance board, the handlebar mount being disposed above the coil spring and aligned with the longitudinal axis of the coil spring, wherein the coil spring is adapted to deflect in response to force applied laterally to the longitudinal axis of the coil spring, wherein a user standing on the balance board or gripping the removable handlebar can controllably maneuver the balance board to maintain the balance board in a substantially horizontal position to simulate riding a bicycle.

15. The training device of claim 14, wherein the coil spring maintains the balance board in a substantially horizontal position and allows pitch and roll of the balance board when subject to force sufficient to overcome the bias of the coil spring.

16. The exercise training device of claim 14, wherein the coil spring defines upper and lower ends, and wherein the upper end can pivot substantially 360° about the lower end of the coil spring affixed to the base.

17. The exercise training device of claim 14, wherein the coil spring is axially compressible and is deflectable about its longitudinal axis in the for-aft direction and laterally.

18. The exercise training device of claim 14, wherein the coil spring is rotatable about its longitudinal axis in response to an applied torque.

* * * * *